US007011100B2

(12) United States Patent
Wu

(10) Patent No.: US 7,011,100 B2
(45) Date of Patent: Mar. 14, 2006

(54) SKELETON FOR EAR-SHAPED UMBRELLA

(76) Inventor: Tsun-Zong Wu, PO Box 82-144, Taipei (TW)

( * ) Notice: Subject to any disclaimer, the term of this patent is extended or adjusted under 35 U.S.C. 154(b) by 302 days.

(21) Appl. No.: 10/688,940

(22) Filed: Oct. 21, 2003

(65) Prior Publication Data

US 2005/0081900 A1 Apr. 21, 2005

(51) Int. Cl.
*A45B 3/00* (2006.01)

(52) U.S. Cl. ..... 135/16; 135/27; 135/32; 135/31; D3/6

(58) Field of Classification Search ..... 135/15.1, 135/16, 23, 27, 31, 32, 33.2; D3/5–6
See application file for complete search history.

(56) References Cited

U.S. PATENT DOCUMENTS 559,577 A * 5/1896 Hadfield ..... 135/27
1,378,354 A * 5/1921 Johnson ..... 135/26
2,143,978 A * 1/1939 Eeeles ..... 135/25.3
4,880,023 A * 11/1989 Lin ..... 135/15.1
5,158,102 A * 10/1992 Lemcke ..... 135/16
6,058,952 A * 5/2000 Lin et al. ..... 135/29
6,186,157 B1 * 2/2001 Lin et al. ..... 135/27
6,227,216 B1 * 5/2001 Dweck ..... 135/15.1
6,588,439 B1 * 7/2003 Wu ..... 135/27

FOREIGN PATENT DOCUMENTS

JP 2001-186912 * 7/2001

* cited by examiner

*Primary Examiner*—Winnie Yip
(74) *Attorney, Agent, or Firm*—Leong C. Lei

(57) ABSTRACT

A skeleton for an umbrella includes multiple sets of rib members, each of which includes a main rib, a first link connected to the main rib, and a stretcher connected at an outer end to the first link. Two opposite sets of the rib members are further provided with a second link connected to a near outer end of the main rib, an elastic first ear-forming rib connected at an inner end to the second link, and a pull cord connected at an inner end to a near outer end of the stretcher and at an outer end to an outer end of the first ear-forming rib. The ear-forming ribs are pulled by the pull cords into curved and tense state to look like two ears at two sides of an animal's head when the umbrella is stretched, and flatly bear against the skeleton when the umbrella is collapsed.

12 Claims, 8 Drawing Sheets

SKELETON FOR EAR-SHAPED UMBRELLA

FIELD OF THE INVENTION

The present invention relates to an ear-shaped umbrella, and more particularly to a skeleton of an umbrella having ear-forming ribs and related components, making the stretched umbrella looked like an animal head with two ears. The ear-forming ribs may be flatly collapsed without increasing a collapsed volume of the umbrella.

BACKGROUND OF THE INVENTION

A general umbrella for shielding against sunshine and rainwater may also be specially designed to have an interesting appearance. For example, the umbrella may include two ears to look like an animal's head, forming a so-called ear-shaped umbrella.

FIG. 1 shows a general skeleton for a conventional ear-shaped umbrella that typically includes a shaft 11, an upper hub 12 fixedly connected to a top of the shaft 11, a lower hub 13 upward and downward movable along the shaft 11, multiple sets of rib members E, and an umbrella cover 14 connected to and covering a top of the rib members E.

Each set of the rib members E includes a main rib 2 connected at an inner end 21 to the upper hub 12, a first link 41 fixedly connected to a near middle point 23 on the main rib 2, and a stretcher 3 connected at an inner end 31 to the lower hub 13 and at an outer end 32 to the first link 41. Two opposite sets of the rib members E that are intended to form two ears on the umbrella are further separately provided with a fourth link 44 fixedly connected to a near middle point 33 of the stretcher 3, a fifth link 45 fixedly connected to the main rib 2 to locate closer to an outer end of the main rib 2 than the first link 41 does, a third ear-forming rib 5 pivotally connected at an inner end 51 to the fourth link 44, and a fourth ear-forming rib 6 pivotally connected at an inner end 61 to the fifth link 45 and at an outer end 62 to an outer end 52 of the third ear-forming rib 5. The third and the fourth ear-forming rib 5, 6 have upward projected outer ends 52, 62 and together form a fixed and bent shape looked like an animal's ear.

The above-structured conventional ear-shaped umbrella has the following disadvantages in using it:

(1) Unlike actual animal ears that are usually located at two sides of the animal's head, the ear-forming ribs 5, 6 are located near a top of the umbrella and above the first link 41. If the ear-forming ribs 5, 6 were moved to locate at two sides of the umbrella below the first links 41, they would be interfered by the first links 41 from being flatly collapsed.

(2) The conventional ear-forming ribs 5, 6 are fixedly bent members that keep in the bent state instead of flatly bearing against the skeleton when the umbrella is collapsed, and therefore increase the collapsed volume of the umbrella to cause inconvenience in carrying the umbrella.

SUMMARY OF THE INVENTION

A primary object of the present invention is to provide an improved skeleton for an ear-shaped umbrella. The skeleton includes multiple sets of rib members, each set of which includes a main rib, a first link connected to a near middle point on the main rib, and a stretcher connected at an outer end to the first link. Two opposite sets of the rib members that are intended for forming two ears further separately include a second link connected to a point near an outer end of the main rib, an elastic first ear-forming rib connected at an inner end to the second link, and a pull cord connected at an inner end to a near outer end of the stretcher and at an outer end to an outer end of the first ear-forming rib directly or via a second ear-forming rib. When the umbrella is stretched, the pull cords pull the ear-forming ribs into curved and tense state to look like two ears at two sides of an animal's head. When the umbrella is collapsed, the ear-forming ribs are released from the tense state to flatly bear against the skeleton.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
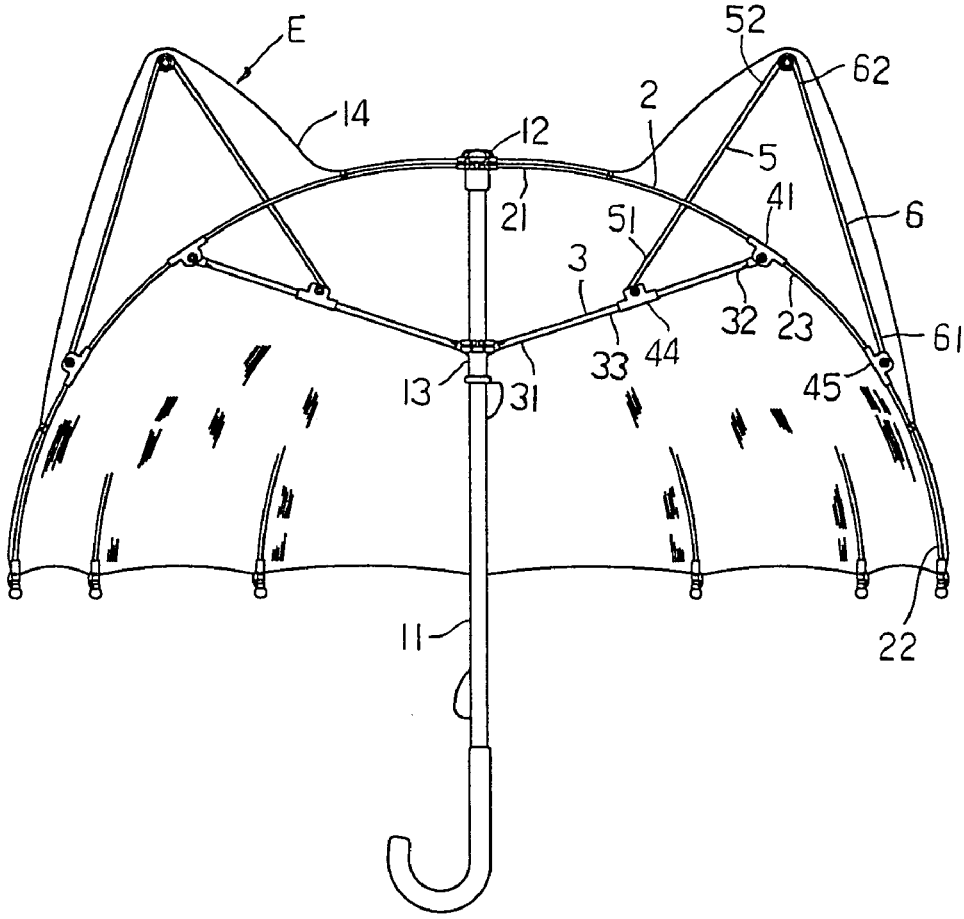
FIG. 1 (Prior Art)
FIG. 1 shows a general skeleton of a conventional ear-shaped umbrella.
Figure 2:
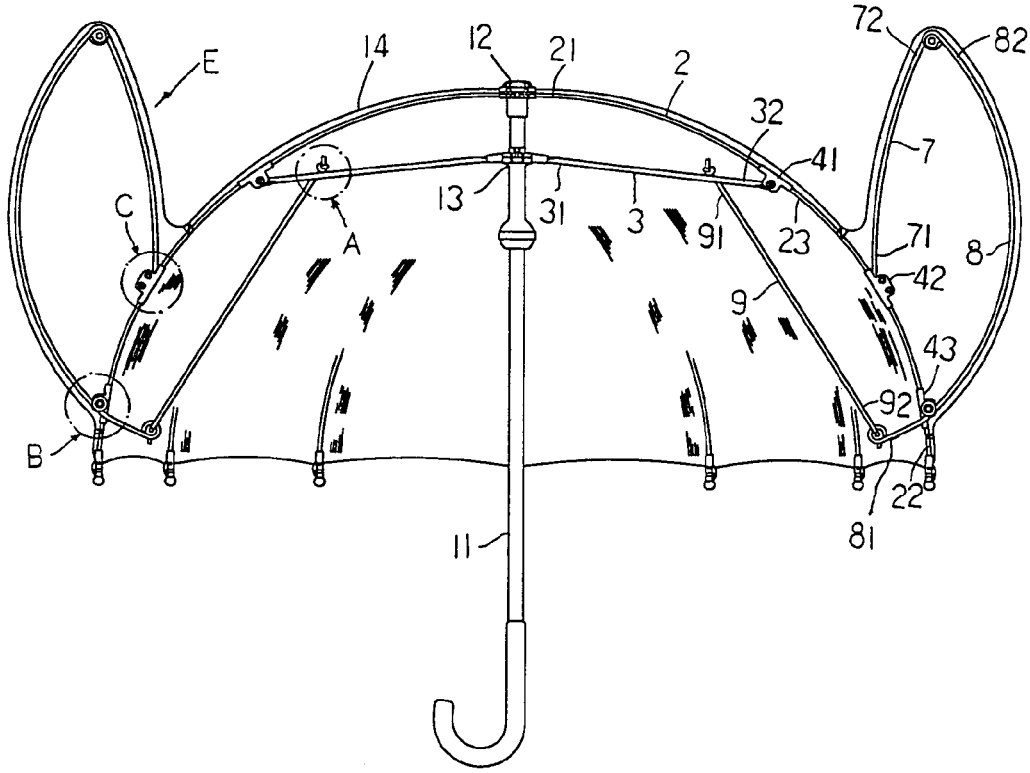
FIG. 2 shows a skeleton for an ear-shaped umbrella according to a first embodiment of the present invention.
Figure 3:
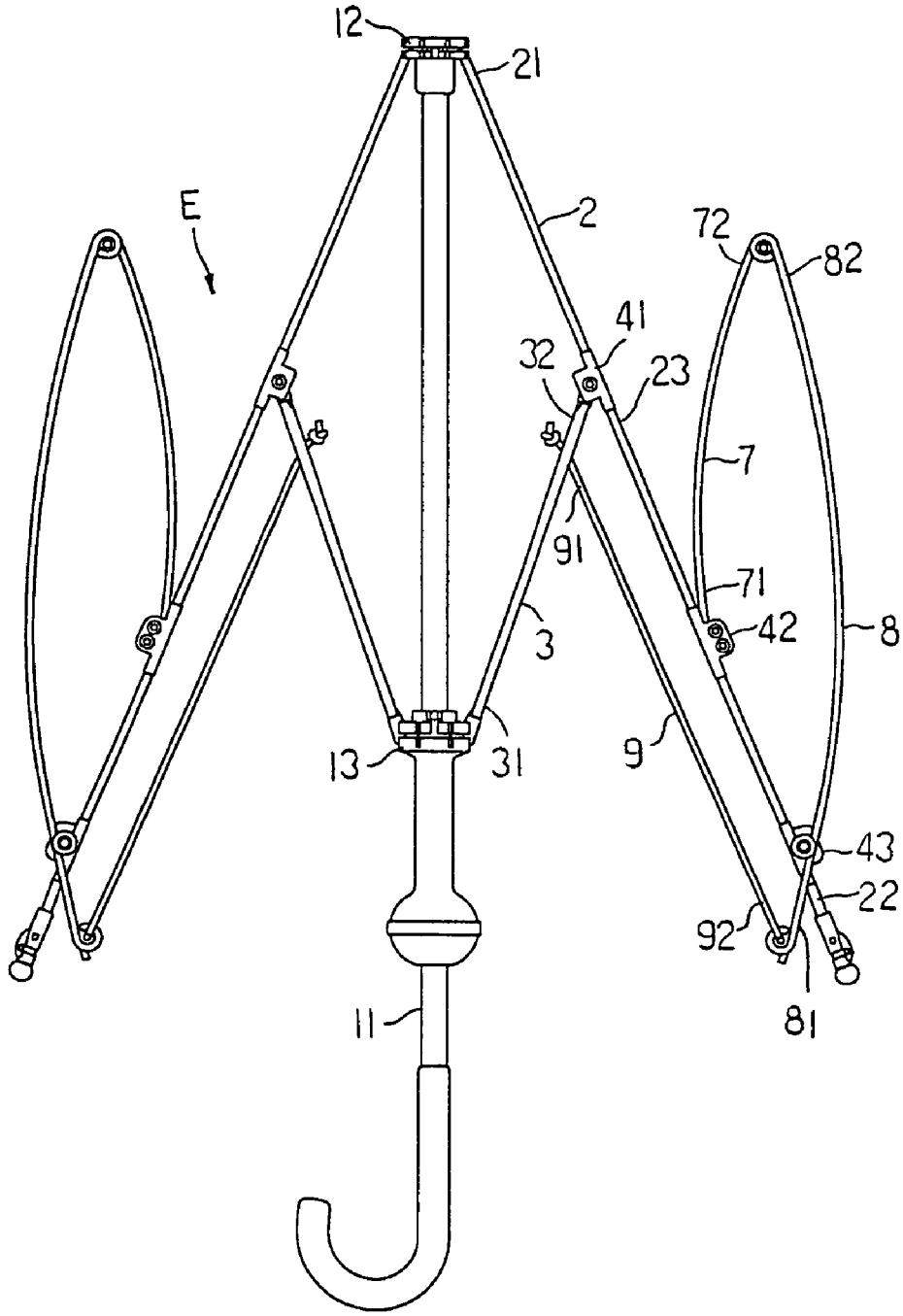
FIG. 3 shows the skeleton of FIG. 2 in a half-collapsed state.

Please refer to FIGS. 2 and 3 that are fully stretched and half-collapsed views, respectively, of a skeleton for an ear-shaped umbrella according to a first embodiment of the present invention. As shown, the skeleton for the ear-shaped umbrella of the present invention mainly includes a shaft 11, an upper hub 12 fixedly connected to a top of the shaft 11, a lower hub 13 upward and downward slidably mounted on the shaft 11, multiple sets of rib members E, and an umbrella cover 14 connected to and covering a top of the rib members E. Each set of the rib members E includes a main rib 2 having an inner end 21 pivotally connected to the upper hub 12, a first link 41 fixedly connected to a near-middle point 23 on the main rib 2, and a stretcher 3 having an inner end 31 and an outer end 32 pivotally connected to the lower hub 13 and the first link, respectively.

Figure 9:
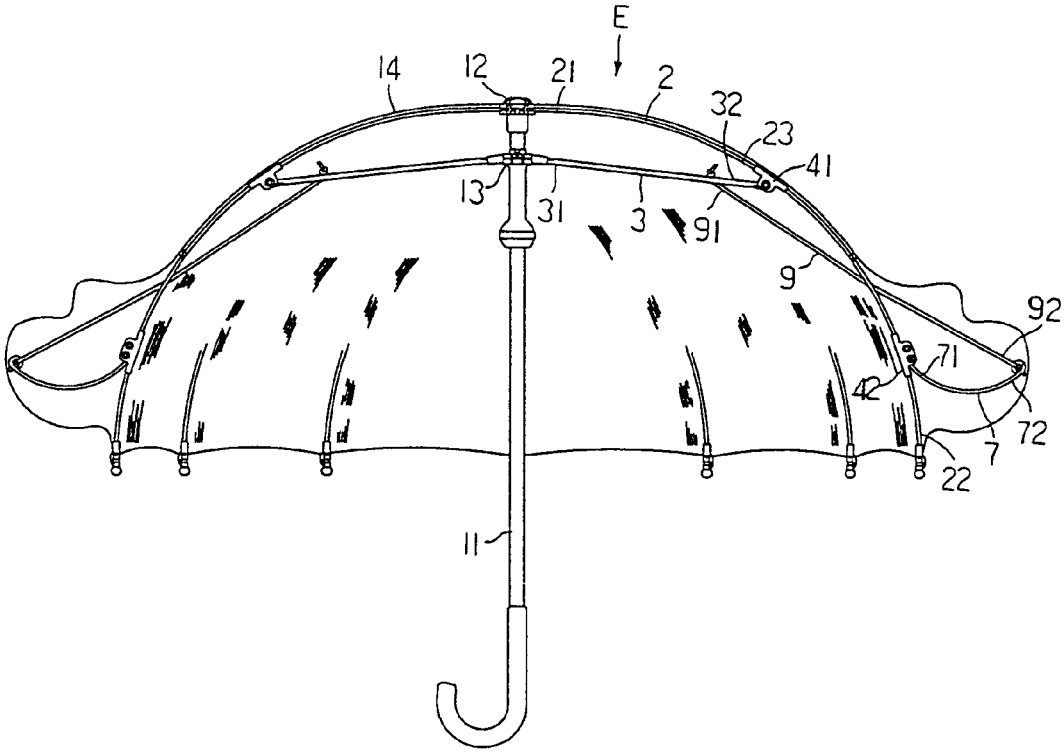
FIG. 9 shows a skeleton for an ear-shaped umbrella according to a second embodiment of the present invention.

Two diametrically opposite sets of the rib members E are intended for forming two ears on the umbrella of the present invention. Each of the two sets of rib members E for forming ears further includes a second link 42 fixedly connected to a point near an outer end 22 of the main rib 2, an elastic first ear-forming rib 7 having an inner end 71 connected to the second link 42, and a pull cord 9 having an inner end 91 tied to a point close to an outer end of the stretcher 3, and an outer end 92 indirectly connected to an outer end 72 of the first ear-forming rib 7 via another ear-forming rib 8. In another embodiment of the present invention as shown in FIG. 9, the outer end 92 of the pull cord 9 is directly tied to the outer end 72 of the first ear-forming rib 7.

The manner of indirectly connecting the outer end 92 of the pull cord 9 to the outer end 72 of the first ear-forming rib 7 via a second ear-forming rib 8 will now be described with reference to FIGS. 2 to 8.

As shown, a third link 43 is fixedly connected to the outer end 22 of the main rib 2, and the second ear-forming rib 8 is pivotally connected at a point near an inner end 81 to the third link 43, tied at the inner end 81 to the outer end 92 of the pull cord 9, and pivotally connected at an outer end 82 to the outer end 72 of the first ear-forming rib 7. Thus, the outer end 92 of the pull cord 9 is indirectly connected to the outer end 72 of the first ear-forming rib 7 via the second ear-forming rib 8. As can be clearly seen from FIGS. 2 and 3, outer ends 72, 82 of the first and the second ear-forming ribs 7, 8 are upward extended from two opposite sides of the umbrella. And, the first and the second ear-forming rib 7, 8 are elastic ribs.

Figure 4:
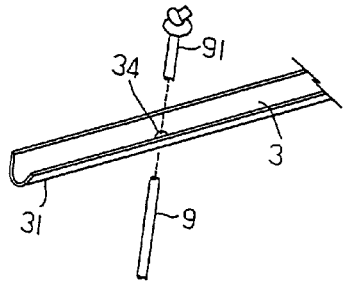
FIG. 4 is an enlarged exploded perspective view of the circled area A of FIG. 2.

Please refer to FIG. 4. The stretcher 3 is an open-topped U-sectioned member having a through hole 34 provided near the outer end thereof. The inner end of the pull cord 9 is extended through the hole 34 on the stretcher 34 and then knotted.

Figure 5:
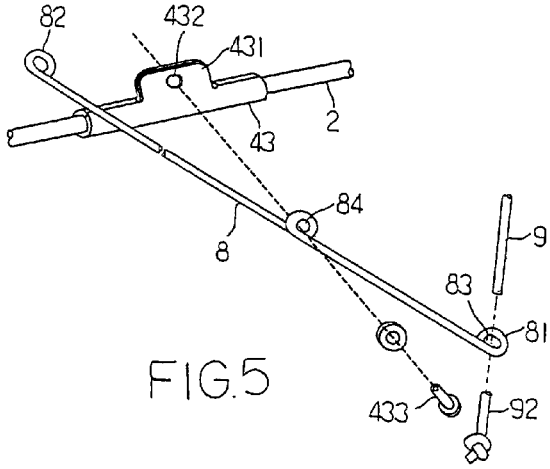
FIG. 5 is an enlarged exploded perspective view of the circled area B of FIG. 2.

FIG. 5 shows the inner end 81 of the second ear-forming rib 8 is provided with an eye 83, and the outer end 92 of the pull cord 9 is extended through the eye 83 and then knotted.

As can be seen from FIG. 5, the third link 43 includes lugs 431 having through holes 432 provided thereon. An eye 84 is provided on the second ear-forming rib 8 near the inner end 81. The second ear-forming rib 8 is pivotally connected to the third link 43 by extending a rivet 433 through the eye 84 and the holes 432 to rivet the rib 8 and the third link 43 together.

Figure 6:
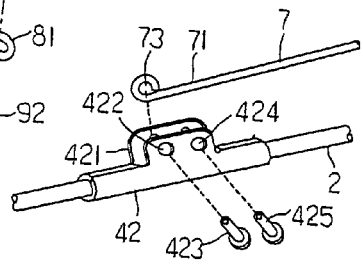
FIG. 6 is an enlarged exploded perspective view of the circled area C of FIG. 2.

FIG. 6 shows the connection of the first ear-forming rib 7 to the second link 42. As shown, the second link 42 includes a pair of lugs 421, each of which is provided with a through hole 422; and the first ear-forming rib 7 is provided at the inner end 71 with an eye 73. A rivet 423 is extended through the eye 73 and the holes 422 to rivet the rib 7 and the second link 42 together. Each of the lugs 421 is also provided with a stop-pin hole 424 for a stop pin 425 to extend therethrough. The inner end 71 of the first ear-forming rib 7 is extended through the pair of lugs 421 below the stop pin 425, and riveted to the through holes 422 on the second link 42 using the rivet 423. The stop pin 425 serves to limit a direction in which the first ear-forming rib 7 is extended.

Figure 7:
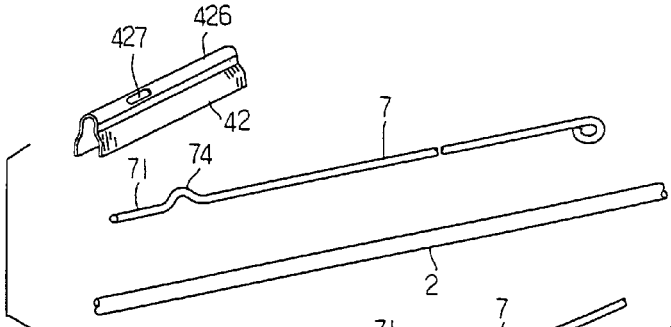
FIG. 7 is an enlarged exploded perspective view showing another embodiment of a second link in the skeleton of the present invention.
Figure 8:
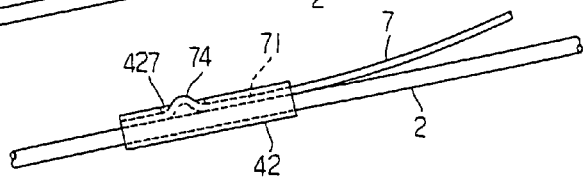
FIG. 8 is an assembled view of FIG. 7.

FIGS. 7 and 8 are exploded and assembled perspective views, respectively, showing another way to connect the first ear-forming rib 7 to the second link 42. In this case, the second link 42 is an open-bottomed member having an upward protruded hollow ridge portion 426, and a slot 427 is formed on the hollow ridge portion 426 at a predetermined position; and the first ear-forming rib 7 is provided near the inner end 71 with a radially projected bent 74. The inner end 71 of the first ear-forming rib 7 is extended through the hollow ridge portion 426 of the second link 42 with the projected bent 74 engaged with and projected from the slot 427. Since the hollow ridge portion 426 extends by a certain length, it serves to limit the direction in which the first ear-forming rib 7 is extended.

When the umbrella is stretched, the elastic first and second ear-forming ribs 7, 8 are pulled by the pull cord 9 into a curve and tense state, as shown in FIG. 2. Since the two sets of first and second ear-forming ribs 7, 8 are separately located at two opposite sides of the skeleton of the umbrella close to the outer end of the main rib 2, the two ears formed from them looked just like two ears on an animal's head. When the umbrella is collapsed, the pull cords 9 are loosened to release the ear-forming ribs 7, 8 from the tense state. At this point, the ribs 7, 8 restore to a naturally straightly extended state due to the elasticity thereof, as shown in FIG. 3. Therefore, the umbrella may be collapsed with the ear-forming ribs 7, 8 flatly bearing against the skeleton. Moreover, since the ear-forming ribs 7, 8 are pivotally connected to the main rib 2 at positions near to an outer end of the first link 41, that is, the first link 41 is located on the main rib 2 at a position outside a section at where the ear-forming ribs 7, 8 are pivotally connected to the main rib 2, the first link 41 would not interfere with the ear-forming ribs 7, 8 in their inward collapse toward the skeleton when the umbrella is collapsed.

Figure 10:
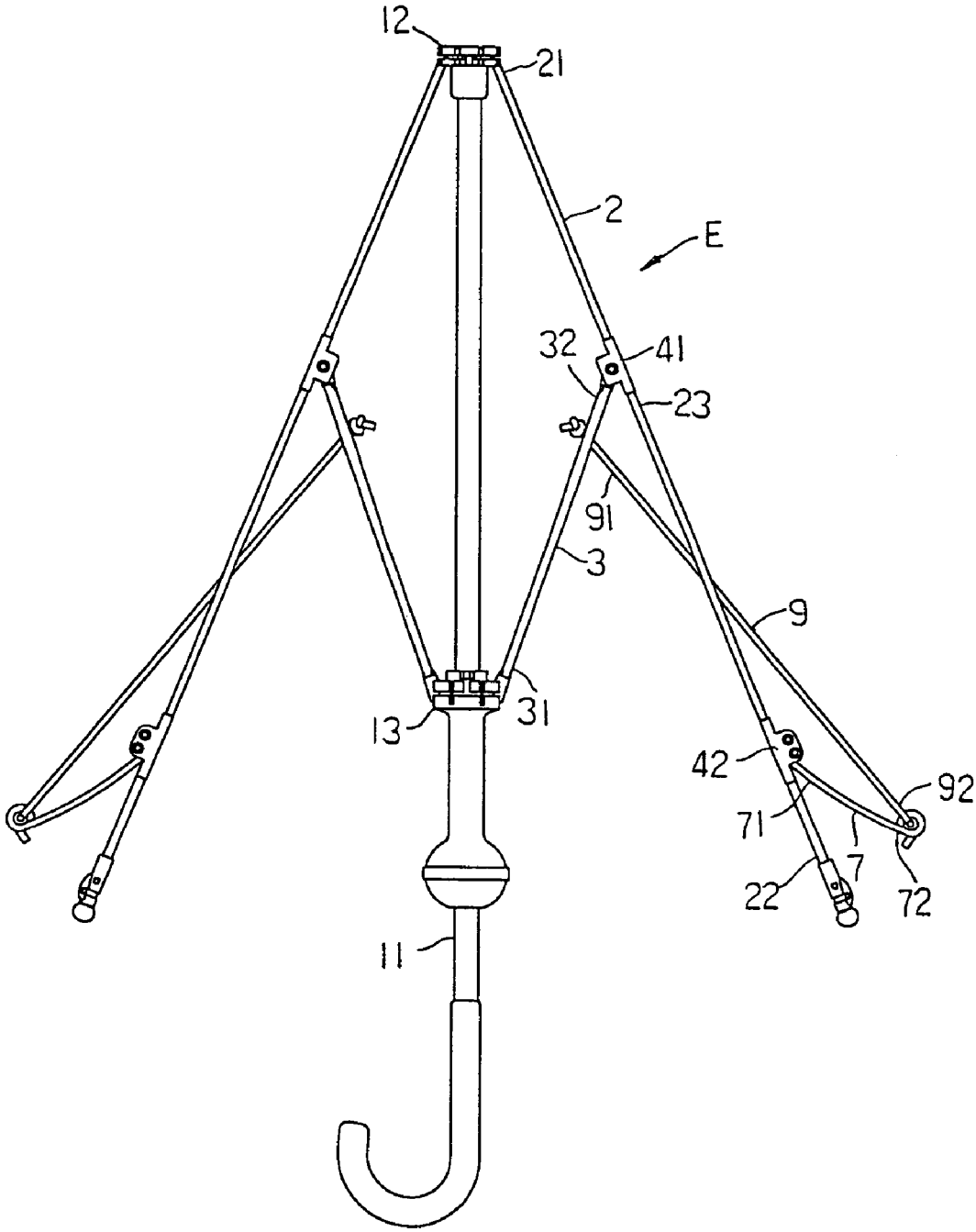
FIG. 10 shows the skeleton of FIG. 9 in a half-collapsed state.

FIG. 9 shows a skeleton for an ear-shaped umbrella according to a second embodiment of the present invention, and FIG. 10 shows the skeleton of FIG. 9 in a half-collapsed state.

The second embodiment shown in FIGS. 9 and 10 is generally similar to the first embodiment shown in FIGS. 2 and 3, except that the outer end 92 of the pull cord 9 is directly tied to the outer end 72 of the first ear-forming rib 7, and the second ear-forming rib 8 is omitted. In this case, the outer end 92 of the pull cord 9 also functions as an ear-forming rib.

Figure 11:
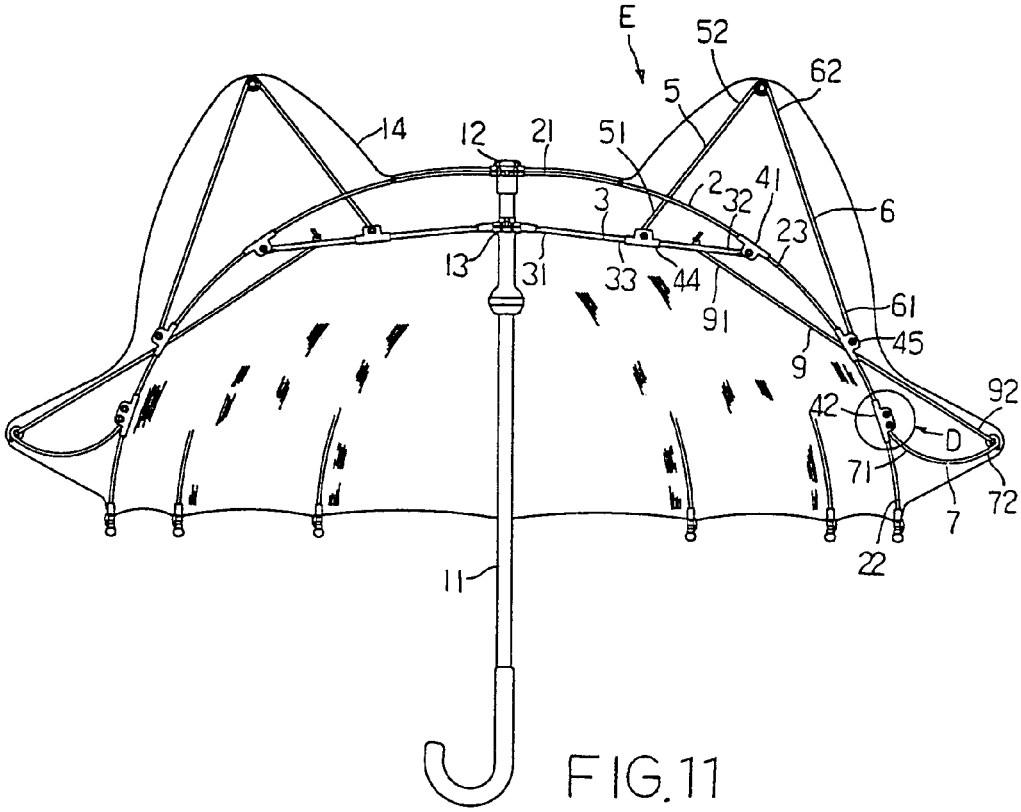
FIG. 11 shows a skeleton for an ear-shaped umbrella according to a third embodiment of the present invention.
Figure 12:
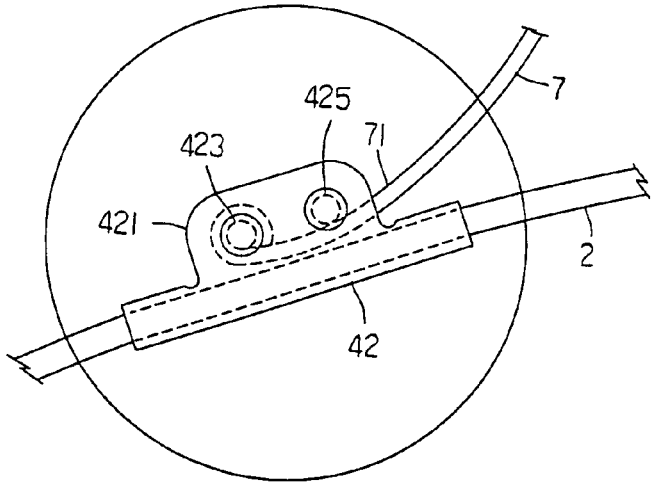
FIG. 12 is an enlarged exploded perspective view of the circled area D of FIG. 11.
Figure 13:
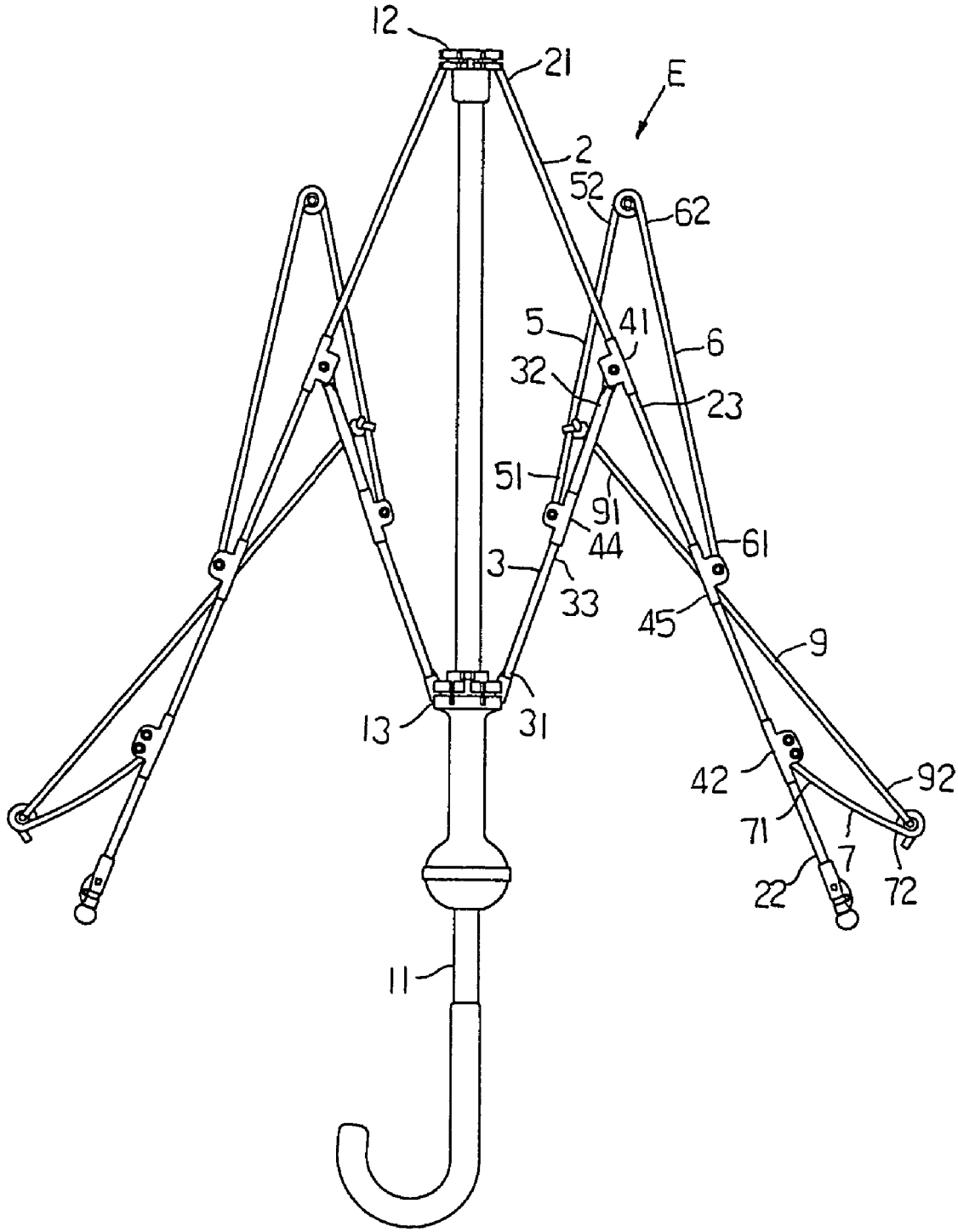
FIG. 13 shows the skeleton of FIG. 11 in a half-collapsed state.

FIG. 11 shows a skeleton for an ear-shaped umbrella according to a third embodiment of the present invention, and FIG. 12 is an enlarged view of the circled area D of FIG. 11, and FIG. 13 shows the skeleton of FIG. 11 in a half-collapsed state.

The third embodiment is a combination of the second embodiment shown in FIG. 9 with two pairs of conventional ear-forming ribs. That is, the third embodiment is formed by adding a fourth link 44, a fifth link 45, a third ear-forming rib 5, and a fourth ear-forming rib 6 to each of the two sets of rib members E for forming ears in the second embodiment. The fourth link 44 is fixedly connected to the stretcher 3 near a middle point 33 of the stretcher 3, the fifth link 45 is fixedly connected to the main rib 2 between the first and the second link 41, 42, the third ear-forming rib 5 is pivotally connected at an inner end to the fourth link 44, and the fourth ear-forming rib 6 is pivotally connected at an inner end to the fifth link 45 and at an outer end to an outer end of the third ear-forming rib 5. Therefore, the skeleton of FIG. 11 creates two pairs of ears on the same one skeleton of an umbrella.

What is claimed is:

1. A skeleton for ear-shaped umbrella, comprising:

a shaft;

an upper hub fixedly connected to a top of said shaft;

a lower hub upward and downward slidably mounted on said shaft;

multiple sets of rib members; and an umbrella cover connected to and covering a top of said multiple sets of rib members;

each set of said rib members including a main rib having an inner end pivotally connected to said upper hub, a first link fixedly connected to a near-middle point on the main rib, and a stretcher having an inner end and an outer end pivotally connected to said lower hub and said first link, respectively;

at least two sets of said rib members that are diametrically opposite to each other further including:

a second link fixedly connected to a point near an outer end of said main rib;

a third link fixedly connected to the outer end of said main rib;

an elastic first ear-forming rib having an inner end connected to said second link;

an elastic second ear-forming rib being pivotally connected at an outer end to an outer end of said first ear-forming rib, and at a near inner end to said third link; and a pull cord having an inner end tied to a point close to an outer end of said stretcher, and an outer end tied to an inner end of said second ear-forming rib.

2. The skeleton for ear-shaped umbrella as claimed in claim 1, wherein said stretcher is an open-topped U-sectioned member, and provided near the outer end with a through hole, via which said inner end of said pull cord is extended and knotted.

3. The skeleton for ear-shaped umbrella as claimed in claim 1, wherein said second ear-forming rib is provided at the inner end with an eye, via which said outer end of said pull cord is extended and knotted.

4. The skeleton for ear-shaped umbrella as claimed in claim 1, wherein said third link includes two lugs, on which two aligned through holes are provided, and said second ear-forming rib being provided at said near inner end with an eye; and said second ear-forming rib and said third link being pivotally riveted together by a rivet extended through said eye at the near inner end of said second ear-forming rib and said through holes on said lugs of said third link.

5. The skeleton for ear-shaped umbrella as claimed in claim 1, wherein said second link includes a pair of lugs, each of which is provided with a through hole, and said first ear-forming rib being provided at the inner end with an eye; and said first ear-forming rib and said second link being pivotally riveted together by a rivet extended through said eye at the inner end of said first ear-forming rib and said through holes on said lugs of said second link; and each of said lugs of said second link being also provided with a stop-pin hole, via which a stop pin is extended; and said inner end of said first ear-forming rib being extended between said two lugs of said second link below said stop pin before being pivotally riveted to said second link, so that a direction in which said first ear-forming rib is extended is limited by said stop pin.

6. The skeleton for ear-shaped umbrella as claimed in claim 1, wherein said second link is an open-bottomed member having an upward protruded hollow ridge portion, at a predetermined position of which a slot is provided; and wherein said first ear-forming rib is provided at the inner end with a radially projected bent; and said inner end of said first ear-forming rib being connected to said second link by extending said inner end through said hollow ridge portion with said bent on said first ear-forming rib engaged with and projected from said slot on said hollow ridge portion, so that a direction in which said first ear-forming rib is extended is limited by said hollow ridge portion that extends by a certain length.

7. A skeleton for ear-shaped umbrella, comprising:

a shaft;

an upper hub fixedly connected to a top of said shaft;

a lower hub upward and downward slidably mounted on said shaft;

multiple sets of rib members; and an umbrella cover connected to and covering a top of said skeleton;

each set of said rib members including a main rib having an inner end pivotally connected to said upper hub, a first link fixedly connected to a near-middle point on the main rib, and a stretcher having an inner end and an outer end pivotally connected to said lower hub and said first link, respectively;

at least two sets of said rib members that are diametrically opposite to each other further including:

a second link fixedly connected to a point near an outer end of said main rib;

an elastic first ear-forming rib having an inner end connected to said second link; and a pull cord having an inner end tied to a point close to an outer end of said stretcher, and an outer end tied to an outer end of said first ear-forming rib.

8. The skeleton for ear-shaped umbrella as claimed in claim 7, wherein said stretcher is an open-topped U-sectioned member, and provided near the outer end with a through hole, via which said inner end of said pull cord is extended and knotted.

9. The skeleton for ear-shaped umbrella as claimed in claim 7, wherein said first ear-forming rib is provided at the outer end with an eye, via which said outer end of said pull cord is extended and knotted.

10. The skeleton for ear-shaped umbrella as claimed in claim 7, wherein said second link includes a pair of lugs, each of which is provided with a through hole, and said first ear-forming rib being provided at the inner end with an eye; and said first ear-forming rib and said second link being pivotally riveted together by a rivet extended through said eye at the inner end of said first ear-forming rib and said through holes on said lugs of said second link; and each of said lugs of said second link being also provided with a stop-pin hole, via which a stop pin is extended; and said inner end of said first ear-forming rib being extended between said two lugs of said second link below said stop pin before being pivotally riveted to said second link, so that a direction in which said first ear-forming rib is extended is limited by said stop pin.

11. The skeleton for ear-shaped umbrella as claimed in claim 7, wherein said second link is an open-bottomed member having an upward protruded hollow ridge portion, at a predetermined position of which as lot is provided; and wherein said first ear-forming rib is provided at the inner end with a radially projected bent; and said inner end of said first ear-forming rib being connected to said second link by extending said inner end through said hollow ridge portion with said bent on said first ear-forming rib engaged with and projected from said slot on said hollow ridge portion, so that a direction in which said first ear-forming rib is extended is limited by said hollow ridge portion that extends by a certain length.

12. The skeleton for ear-shaped umbrella as claimed in claim 7, wherein each of said two diametrically opposite sets of rib members including said second link, said first ear-forming rib, and said pull cord further includes:

a fourth link fixedly connected to a near-middle point of said stretcher;

a fifth link fixedly connected to said main rib between said first and said second link;

a third ear-forming rib being pivotally connected at an inner end to said fourth link; and a fourth ear-forming rib being pivotally connected at an inner end to said fifth link, and at an outer end to an outer end of said third ear-forming rib.

* * * * *